US007553108B2

(12) United States Patent
Langwadt et al.

(10) Patent No.: US 7,553,108 B2
(45) Date of Patent: Jun. 30, 2009

(54) METHOD AND ARRANGEMENT FOR STRESSING A STAGGERED ANCHORAGE

(75) Inventors: Otmar Langwadt, Markt Schwaben (DE); Frank Schmidt, Munich (DE)

(73) Assignee: Dywidag-Systems International GmbH, Aschheim (DE)

( * ) Notice: Subject to any disclaimer, the term of this patent is extended or adjusted under 35 U.S.C. 154(b) by 310 days.

(21) Appl. No.: 11/372,196

(22) Filed: Mar. 10, 2006

(65) Prior Publication Data

US 2006/0201100 A1 Sep. 14, 2006

(30) Foreign Application Priority Data

Mar. 10, 2005 (DE) ..... 10 2005 010 957

(51) Int. Cl.
*E02D 5/74* (2006.01)

(52) U.S. Cl. ..... 405/259.1; 52/223.1; 405/302.2

(58) Field of Classification Search ..... 405/259.1, 405/302.2; 52/223.1
See application file for complete search history.

(56) References Cited

U.S. PATENT DOCUMENTS

| | | | | |
|---|---|---|---|---|
| 3,412,511 | A * | 11/1968 | Dietrich | 254/29 A |
| 3,647,184 | A * | 3/1972 | Vanderhurst et al. | 254/29 A |
| 3,658,296 | A * | 4/1972 | Yegge | 254/29 A |
| 3,801,067 | A * | 4/1974 | Shorter | 254/29 A |
| 3,844,023 | A * | 10/1974 | Surribas et al. | 254/29 A |
| 4,819,393 | A * | 4/1989 | Augoyard | 52/223.13 |
| 5,596,854 | A * | 1/1997 | Crigler | 405/259.1 |
| 5,809,710 | A * | 9/1998 | Jungwirth et al. | 52/223.1 |
| 6,571,518 | B1 * | 6/2003 | Barley | 405/259.1 |
| 2003/0099518 | A1 * | 5/2003 | Barley | 405/259.1 |

FOREIGN PATENT DOCUMENTS

| | | |
|---|---|---|
| DE | 23 08 216 A | 8/1974 |
| DE | 41 38 470 A1 | 5/1993 |
| DE | 195 35 700 A1 | 4/1997 |
| DE | 195 36 701 A1 | 4/1997 |
| DE | 100 37 516 C1 | 1/2002 |
| EP | 0 356 215 A2 | 2/1990 |

* cited by examiner

*Primary Examiner*—Frederick L Lagman
(74) *Attorney, Agent, or Firm*—Muncy, Geissler, Olds & Lowe, PLLC

(57) ABSTRACT

A method and apparatus for tensioning a staggered anchorage comprised of a plurality of tension members, which are anchored in a bore hole at various depths, thus having different free steel lengths. For each staggered anchorage, each tension member is tensioned up to a predetermined maximal load and is then subsequently adjusted to the working load. To achieve a consistent elongation reserve of the individual tension member and thus to increase the security of a staggered anchorage, the staggered anchorage is adjusted to the working load, all tension members are adjusted to a reduced elongation ($\Delta l_w$) by a uniform elongation difference ($\Delta l_{max}-\Delta l_w$) relative to the respective elongation ($\Delta l_{max}$) of the predetermined maximal load. An arrangement for performing the method has a single tensioning plane, which is force interconnected with defined locking elements that are arranged on tension members in clamping planes.

31 Claims, 6 Drawing Sheets

METHOD AND ARRANGEMENT FOR STRESSING A STAGGERED ANCHORAGE

This nonprovisional application claims priority under 35 U.S.C. § 119(a) on German Patent Application No. DE 2005 010 957.8-25, which was filed in Germany on Mar. 10, 2005, and which is herein incorporated by reference.

BACKGROUND OF THE INVENTION

1. Field of the Invention

The present invention relates to a method and an arrangement for tensioning a staggered anchorage.

2. Description of the Background Art

Pressure-grouted anchorages are known, for example, as ground or rock anchorages. They are generally comprised of a plurality of axis-parallel tension members of steel rods, steel wires, or steel wire strands, which are guided into a bore hole. By grouting at the furthest end of the bore hole, a grouted body is formed, which bonds the tension members with the surrounding ground for transmitting a load to the underground. The longitudinal segment of a tension member, which facilitates load transfer, is referred to as an anchorage length $L_{tb}$. At their opposite end, the tension members are anchored, with the aid of anchorage wedges, in an anchorage disk, which rests on an above-ground bore hole end. During the tensioning of the pressure-grouted anchorage, the tension members in the area between the anchorage disk and the grouted body can elongate freely. Therefore, this area is also referred to as a free steel length $L_{tf}$.

A staggered anchorage is a special embodiment of a pressure-grouted anchorage, wherein the load transmission area is not concentrated at an end of the pressure-grouted anchorage, but instead is distributed over a larger longitudinal section of the pressure-grouted anchorage. By distributing the anchorage force over an extended load transmission area, a more balanced loading into the underground takes place, thus improving the anchorage effect. The distribution of the load is achieved by utilizing tension members of varying length, the ends of which terminate at various bore hole depths. The result thereof is an axial staggering of an anchorage length $L_{tb}$ in the bore hole.

When tensioning a pressure-grouted anchorage, industrial standards require that, for security reasons, the tension members are tensioned to a defined test load $F_p$ before subsequently being impacted, by repeated de-tensioning and re-tensioning, with the required working load. For the tensioning operation, it is common for pressure-grouted anchorages with tension members of identical length to use a multistrand jack, whereby with one hoist of the jack, all tension members are elongated simultaneously and to the same extent. Thus, all tension members are in the same state of tension during the tensioning process.

In contrast, the problem with tensioning staggered anchorage is that with uniform elongation of all tension members, varying states of tension would occur due to their different free steel lengths $L_{tf}$. Shorter tension members would be subjected to more stress as compared to longer tension members so that in shorter tension members, the test load $F_p$ would already be reached at an elongation, at which longer tension members would still be far below the test load $F_p$.

For this reason, staggered anchorages are tensioned with hydraulically interconnected monojacks, that is, there is one dedicated jack for each tension member, which tensions the tension member until the test load $F_p$ is reached. As a result of the varying free steel lengths $L_{tf}$ of the tension members, different elongation values are obtained. Once the test load $F_p$ is reached, the individual tension members are adjusted to a uniform working load, that is, after the tensioning operation is completed, all tension members, regardless of their length, have the same working load.

The necessity to have on hand and to operate multiple monojacks, has proven to be extremely costly, both technically and economically. In addition, using multiple monojacks entails considerable expenditures for the required measuring and logging labor. Although, from a technical viewpoint, applying a uniform working load to the individual tension members helps achieve a high anchorage force, however, it has the disadvantage that in the event of unexpected elongation of the anchorage, for example, due to deformations below ground, the elongation reserves of the individual tension members are different. With tension members of shorter free steel lengths, the reserves will be used up after a short overelongation, thus running the risk that these tension members fail.

SUMMARY OF THE INVENTION

It is therefore an object of the present invention to provide a method and an arrangement for tensioning staggered anchorages that simplifies the tensioning operation and improves the load behavior of a staggered anchorage when overelongated.

An embodiment of the invention provides for an adjustment of the tension members of a staggered anchorage, starting at their respective elongation at a predetermined maximal load, to the operational state of the staggered anchorage such that all tension members in the operational state are less tensioned by a uniform length value than at a predetermined maximal load. The elongation difference of the tension members between pre-tensioning at the predetermined maximal load and the working load is thus an identical value for all tension members. However, due to varying free steel lengths of the individual tension members, the uniform length alteration of the tension members leads to varying states of tension of the individual tension members at a transition to the state of operation.

The predetermined maximal load is thereby freely selectable in accordance with specific requirements of the respective application, and beneficially is equal to the test load $F_p$ of the tension members to fully utilize their potential bearing capacity.

The great benefit derived therefrom is such that when tensioned beyond the working load until the maximum allowable load of the staggered anchorage is reached, all tension members have the same bearing reserves, irrespective of their lengths. The maximum allowable load thereby corresponds to the state of tension of the staggered anchorage, whereby all tension members are impacted with the predetermined maximum load, preferably the test load $F_p$. Thus, a beneficial feature of a staggered anchorage of the present invention is great safety from failure.

The tension members of the staggered anchorage can be tensioned with monojacks to a predetermined maximum load, then de-tensioning them, either path-dependently or force-dependently. The de-tensioning of the tension members can thereby be done individually or simultaneously. Thereafter, all tension members of the staggered anchorage have a uniform load reserve.

Since this still requires expenditures not to be neglected when tensioning the tension members, an embodiment of the invention goes a different route. Starting with the varying free steel lengths $L_{tf}$ of the individual tension members, the elongation value to reach a predetermined maximal load, preferably the test load $F_p$, is thereby calculated for each tension member. Based thereon, all tension members are tensioned in only one tensioning plane, whereby tension members with different free steel lengths are tensioned successively and with different, previously calculated elongations until the predetermined maximum load is reached. A result of the elongation differences in the steel elongation of various tension members is that only when the predetermined maximal load is reached is the same state of tension present in all tension members at the same time.

The initial advantage of this method is that only one jack is needed for the tensioning operation. This can be a commercially available multistrand jack, whereby the user of a method of the present invention is merely faced with minor investment expenditures as compared to the use of monojacks. The tensioning of a staggered anchorage is limited to only one stroke and is thus quickly accomplished. Since only one jack is utilized, there is little expenditure for measuring and logging tasks. The benefit of the invention is a simple operation and quick execution of the tensioning procedure, which last but not least increases its economic efficiency.

After tensioning the tension members to the predetermined maximum load, the staggered anchorage is adjusted to the service load state. Again, a state is thereby generated, whereby the individual tension members are all less elongated at the identical value, as compared to the elongation under the predetermined maximal load. Thus, under the working load of the staggered anchorage, all tension members have identical elongation reserves before reaching the predetermined maximal load. If the staggered anchorage is overelongated in the service state, the anchorage force can therefore be increased without overtensioning the anchorage. The highest efficiency and thus maximum load capacity is achieved when the predetermined load is reached simultaneously in all tension members. Thus, a pretensioned staggered anchorage according to the present invention provides optimum safety from overelongation while allowing a simple and quick execution of the tensioning operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
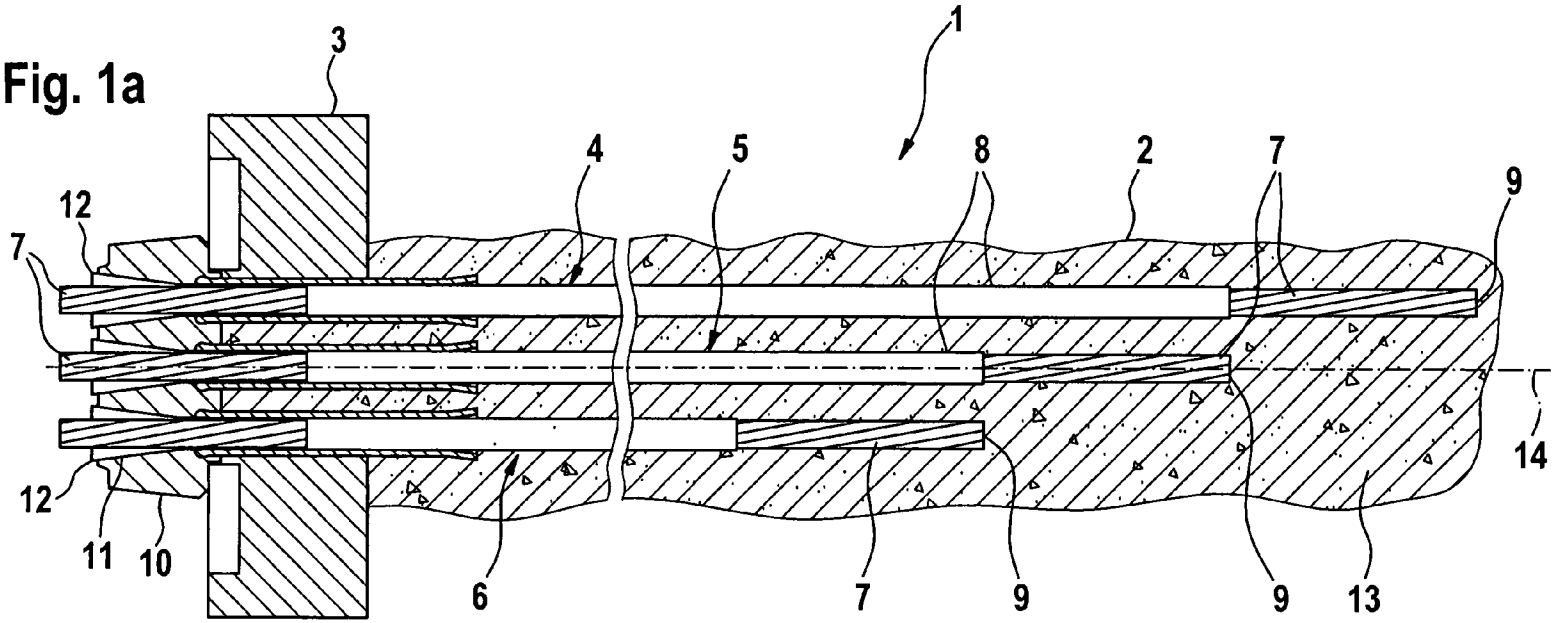
FIG. 1*a* is a longitudinal cross section of a tensioned staggered anchorage.

FIG. 1 shows a ground anchorage as a staggered anchorage 1 in a service state. The staggered anchorage 1 is guided into a bore hole 2, the top opening of which is enclosed by a base plate 3. The base plate 3 has a central opening, through which the staggered anchorage 1 extends with its above-ground end. A longitudinal axis of the staggered anchorage 1 has the reference numeral 14.

The staggered anchorage 1 includes a plurality of axis-parallel tension members 4, 5, and 6. Each tension member 4, 5, and 6 has a steel wire strand 7, which along most of its length is provided with a sheathing 8. In contrast, the end 9 of the steel wire strand 7 assigned to the bottom of the bore hole remains bare. Due to the different lengths of the tension members 4, 5, and 6, an arrangement of the ends 9 of the steel wire strands 7 in the bore hole 2 is formed that is staggered in the longitudinal direction 14 of the staggered anchorage 1.

The opposite, above-ground ends of the tension members 4, 5, and 6 are threaded through bores in an anchorage disk 10. In order to form a receptacle 11, the bores expand conically in the direction of the open ends of the tension members 4, 5, and 6. In the receptacles 11, three-part segment-shaped anchorage wedges 12 are arranged in a conventional fashion, which rest upon the anchorage disk 10, thus exerting a clamping effect on the steel wire strands 7, which causes an anchorage of the steel wire strands 7 in the anchorage disk 10.

To transmit the anchorage force underground, the bore hole 2 is grouted with an injection mortar 13. In the area of the free ends 9, a bonding takes place of the strands 7 with the injection mortar 13 so that the anchorage force is transmitted to the walls of the bore hole 2, and furthermore, to the surrounding ground. The area of the tension members 4, 5, and 6, which is effective in the load transfer to the underground, is referred to as anchorage length $L_{tb}$.

In the area of the sheathing 8, on the other hand, the sheathing 8 prevents the forming of a friction-locked bond between the strands 7 and the injection mortar 13. Despite the injection mortar 13, the strands 7 are quite flexibly arranged in the sheathing 8 so that in the area of the sheathing 8 no load transfer below ground takes place. The area of the free expandability of the strands 7 is referred to as a free steel length $L_{tf}$, and is only shown for the tension member 6 in FIG. 1*b*.

Figure 1B:
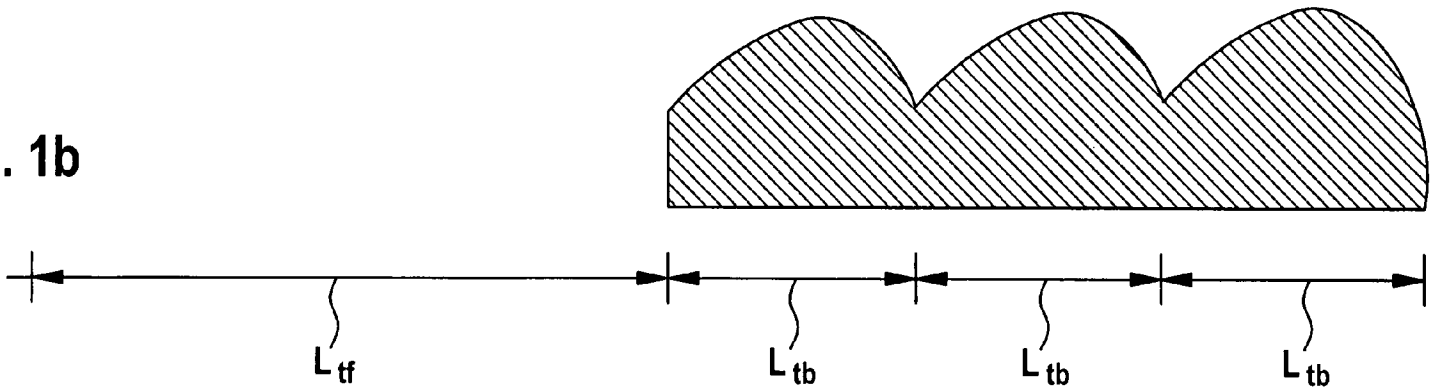
FIG. 1*b* shows the load transfer zone of the staggered anchorage illustrated in FIG. 1*a;*

As can be seen in FIG. 1*b*, with a staggered anchorage 1, the load transfer to the underground is done in accordance with the staggered arrangement of the free ends 9 of the steel wire strands 7 in the bore hole 2. Thus, the anchorage force is not transferred to the underground concentrated in one anchorage plane, but via a longitudinal segment that is definable by selecting the staggering of the tension members 4, 5, and 6, which in the instant embodiment is three times the anchorage length $L_{tb}$.

Figure 2:
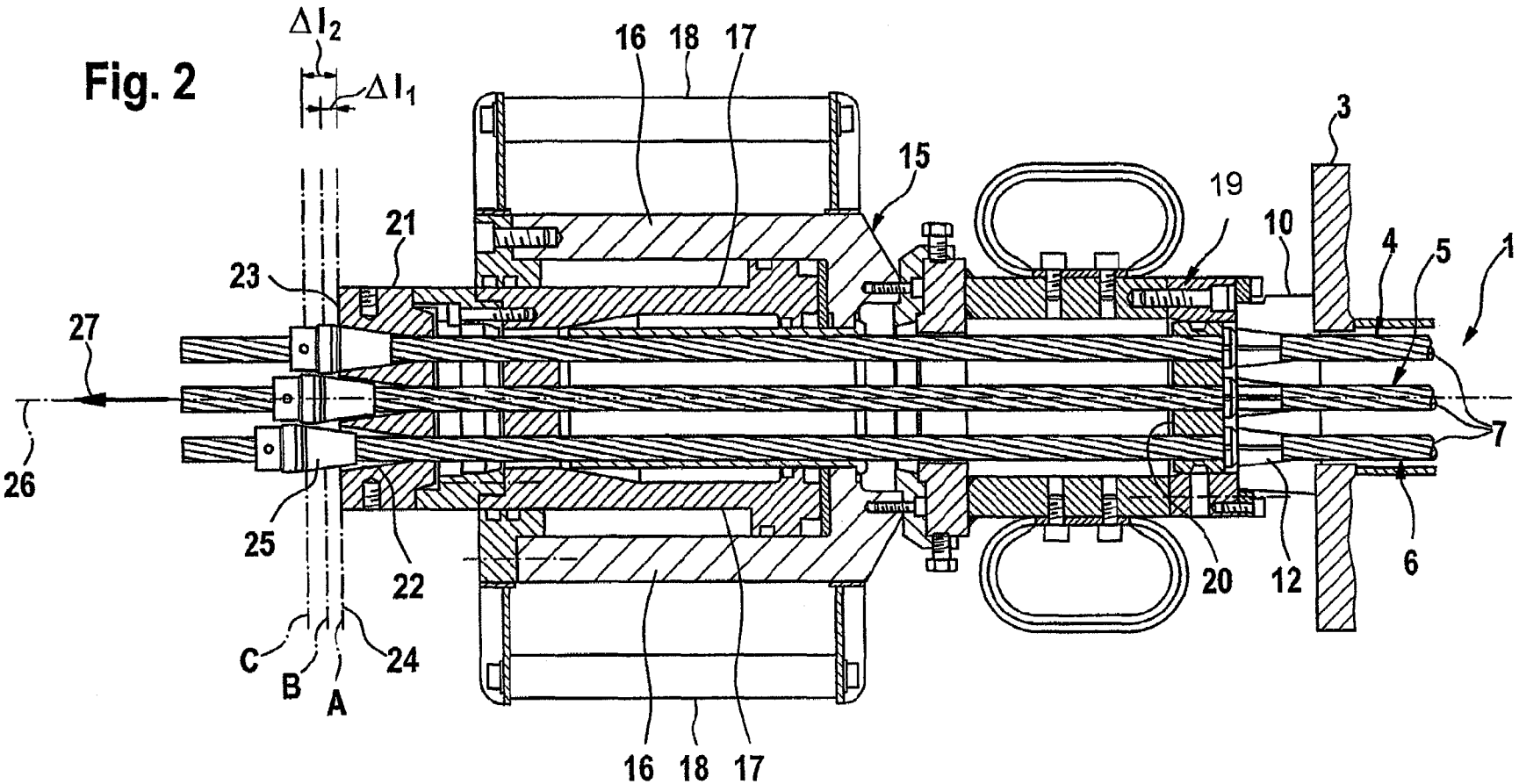
FIG. 2 is a longitudinal cross section of an arrangement of the present invention for tensioning the staggered anchorage illustrated in FIG. 1.

FIG. 2 shows a longitudinal cross section of an arrangement for tensioning the staggered anchorage 1 described in FIG. 1. On the right side of the illustration, the above-ground end of the staggered anchorage 1, including base plate 3, anchorage disk 10, and anchorage wedges 12 can be seen. At the time the staggered anchorage 1 is being tensioned, the strands 7 of the tension members 4, 5, and 6, do not yet terminate behind the anchorage wedges 12 (see FIG. 1) but extend in the longitudinal axis 14 of the staggered anchorage 1 to allow the setup of a tensioning arrangement.

The tensioning arrangement illustrated in FIG. 2 also includes a multistrand jack 15 having a cylinder 16, which is oriented in the longitudinal axis 14 of the anchorage and forms a housing of the multistrand jack 15, and a piston 17 that is slidably arranged inside the cylinder. For easier handling, the cylinder 16 is provided with handles 18. The piston 17 has a central passage for the strands 7 of the tension members 4, 5, and 6.

FIG. 2 shows the multistrand jack 15 in an initial position for the tensioning operation, whereby the piston 17 is completely retracted in the cylinder 16. To tension the staggered anchorage 1, the piston 17 is extended. The tensioning path followed by the piston 17 thereby defines a tensioning axis 26 as well as a tension direction 27.

At the bore-hole side, the multistrand jack 15 rests on a hollow cylindrical component 19, the purpose of which is to retain the anchorage wedges 12 in the receptacles 11 of the anchorage disk 10 during the tensioning of the tension members 4, 5, and 6. The component 19 is therefor positioned on the anchorage disk 10, and is thus force-transmittingly inserted between the multistrand jack 15 and the anchorage disk 10. The retaining of the anchorage wedges 12 is done by wedge retaining disk 20, which seals the face side of component 19. During the test procedure, when the tension members 4, 5, 6, are being detensioned, it moves with the anchorage wedges 12. Only after the last detensioning operation and prior to the retensioning of the tension members 4, 5, 6, to the working load $F_w$ is the wedge retaining plate 20 fixed in the component 19.

At its free end, the piston 17 carries a clamping plate 21, which also has the shape of a perforated disk and in design is almost identical to the anchorage disk 10. Thus, the clamping plate 21 has passage bores, which expand conically towards its face side 23 to form receptacles 22. Running through each receptacle 22 is the bare strand 7 of tension members 4, 5, and 6, thus extending beyond the face side 23 of the clamping plate 21 with its free end.

On the projecting ends of the strands 7, locking elements in form of clamping wedges 25 are mounted, which serve the purpose of fixing the strands 7 into place against the clamping plate 21 in a tension direction 27 for the tensioning operation. This is done by wedging the strands 7 in with a clamping wedge 25, which in turn rests on the walls of the receptacle 22 of the clamping plate 21. The clamping force is transmitted across the entire length of the clamping wedge 25 into the strands 7. However, to simplify the appreciation of the invention, henceforth, the clamping force is reduced to an idealized clamping plane A, B, C, which is oriented radially to the tensioning axis 26 and is clamping wedge-specific.

As can be seen in FIG. 2, prior to tensioning, the clamping wedges 25 are in a staggered arrangement in the tensioning direction 26. The clamping wedge 25 for the strand 7 of tension member 4 thus defines the clamping plane A, the clamping wedge 25 for the strand 7 of tension member 5 defines the clamping plane B, and the clamping wedge 25 for strand 7 of the shortest tension member 6 defines the clamping plane C. In FIG. 2, the distance of clamping plane B to clamping plane A is referenced as $\Delta I_1$, the distance of clamping plane C to clamping plane A is referenced as $\Delta I_2$.

In contrast thereto, referred to as tensioning plane 24 is the plane that extends radially to the tensioning axis 26, which, during the tensioning procedure of the staggered anchorage 1, moves in tensioning direction 27, thus transferring the tensioning force to the tension members 4, 5, 6. Consequently, an impacting of a strand 7, and thus a tension member 4, 5, 6, with tensioning force, does not occur until the tensioning plane 24 is congruent with one of clamping planes A, B, C.

In the example embodiment, the clamping plate 21 embodies the tensioning plane 24. The tensioning plane 24 and one of clamping planes A, B, C. are congruent as soon as the clamping wedge 25 is firmly positioned in the receptacle 22 of clamping plate 21. This state is illustrated in FIG. 2 for tension member 4. In addition, as a result of the geometric adaptation of the receptacles 22 of clamping plate 21 to the geometry of the clamping wedges 25, the tensioning plane 24 is located in a plane of a side face 23 of the clamping plate 21.

The function of the described arrangement as well as the procedure of the tensioning operation will be explained in more detail below with reference to FIG. 9.

Figure 3A:
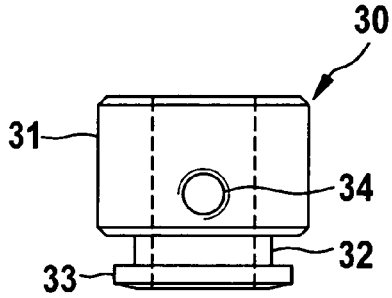
FIGS. 3*a* and 3*b* are lateral and top views of a fixing segment of a tensioning wedge of the arrangement illustrated in FIG. 2, according to an embodiment of the invention.
Figure 3B:
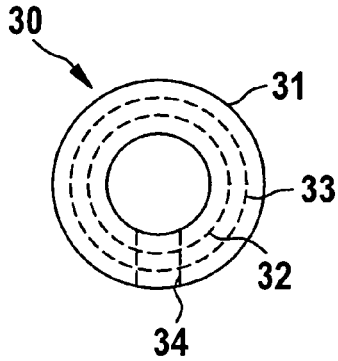
Figure 6:
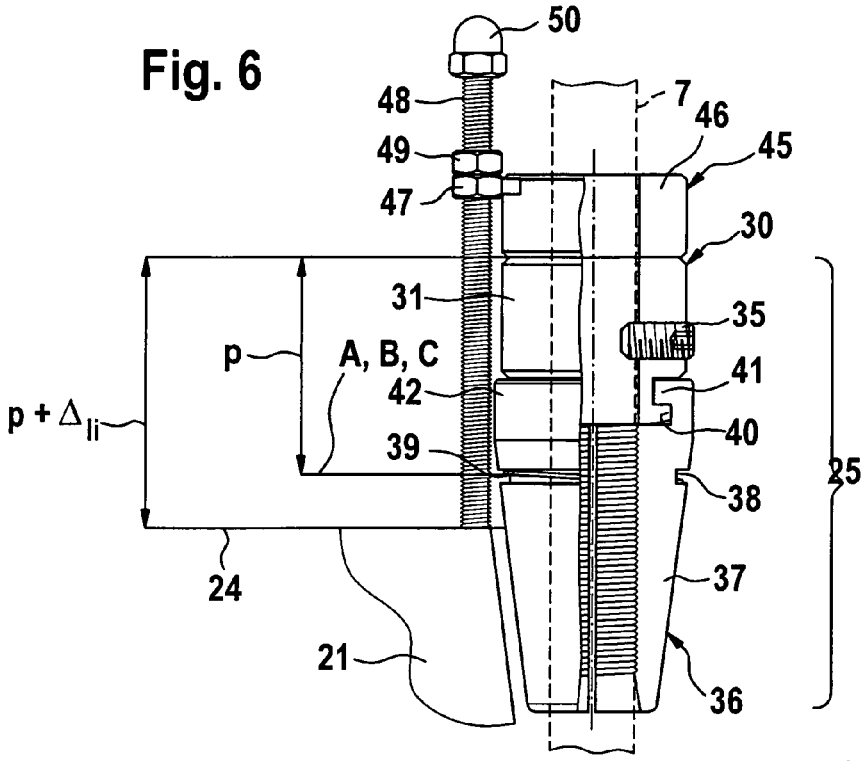
FIG. 6 is a partial cross-sectional lateral view of a tensioning wedge in combination with an adjustment element according to an embodiment of the present invention.

The more detailed construction of the clamping wedge 25 of the tensioning arrangement is shown in its entirety in FIG. 6, and its individual components in FIGS. 3*a*, 3*b*, 4*a*, 4*b*. FIGS. 3*a* and 3*b* illustrate the fixing segment 30 of the clamping wedge 25 in plan and top view. The fixing segment 30 is formed by a thick-walled hollow cylinder 31, in the lower region of the outer shell of which an annular slot 32 is milled in. In this way, an annular flange 33 is formed on the lower front face, which features an outer diameter that is smaller than that of the hollow cylinder 31. Half-way up the fixing segment 30, there is also a threaded bore 34 extending radially through the cylinder walls, which serves as a receptacle for a stud screw 35 (FIG. 6).

Figure 4A:
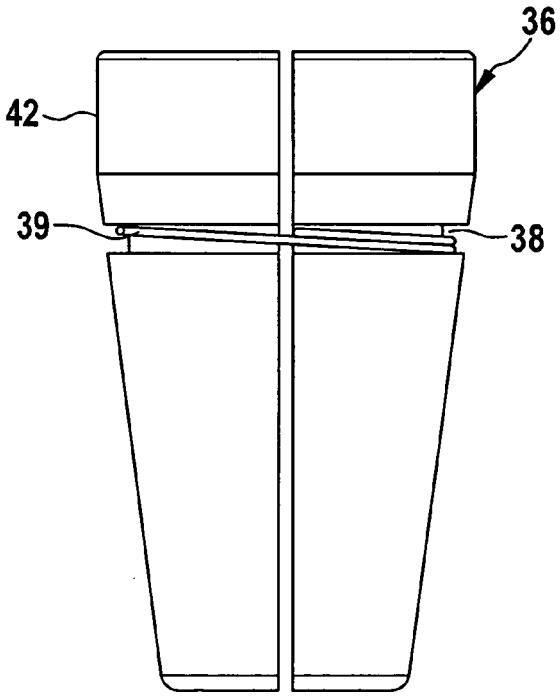
FIGS. 4*a* and 4*b* are lateral and top views of a clamping segment of a tensioning wedge of the arrangement illustrated in FIG. 2, according to an embodiment of the invention.
Figure 4B:
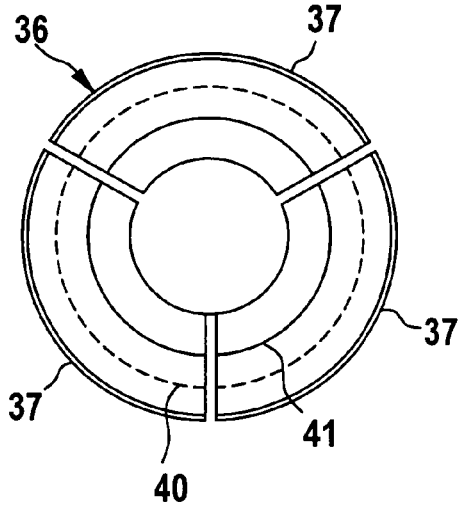

In the operational state, the fixing segment 30 is axially united with the clamping segment 36 illustrated in FIGS. 4*a* and 4*b*, to form a complete clamping wedge 25 according to the invention. The clamping segment 36 is essentially comprised of three identical wedge segments 37, which, assembled cylindrically, have the shape of a truncated cone with axial passage bores. To improve the transfer of the clamping force, the walls of the passage bores have a profiled surface. On their outer periphery, the segments 37 are provided with an annular slot 38, in which an annular spring 39 is arranged that holds the three segments 37 together.

A further feature of the invention is that in the thick-walled area, the segments 37 extend axially with a constant thickness to mutually form a connecting shaft 42. In this area, the segments 37 are provided with an interior annular slot 40 so that an annular flange 41 (FIG. 6) is formed at a face-side end of the connecting shaft 42.

In FIG. 6, a complete clamping wedge 25 is illustrated, partly in lateral view, partly in longitudinal view. It can be seen how a form-fitting connection is formed by positioning the fixing segment 30 and the clamping segment 36 side-by-side axially, whereby the annular flanges 33 and 41 engage with the annular slots 32 and 38, respectively, for forming a gearing.

In the longitudinal axis of the clamping wedge 25, the fixing segment 30 and the clamping segment 36 form a continuous hollow cavity so that an axial sliding of the clamping wedge 25 onto the open end of strand 7 (only indicated with dotted lines in FIG. 6) is possible. When the stud screw 35 is screwed in, it penetrates the continuous hollow cavity, thereby encountering the strand 7 extending therein. Thus, by using the set screw 35, it is possible to fix the fixing segment 30, and thereby the entire clamping wedge 25, into place against the strand 7.

Because the clamping wedges 25 define the clamping planes A, B, C, it is essential for the invention that the clamping wedges 25 are attached on the strands 7 in their proper position. For their proper position, the previously calculated axial distance ΔI in between the clamping wedges 25 is relevant. The axial distance ΔI between the clamping wedges 25 and the tension members 4, 5, or 6, according to the invention, respectively equals the difference of the elongations of the individual tension members when the predetermined ultimate load is applied to each tension member, relative to their untensioned initial state. This elongation difference ΔI can be mathematically calculated if the free steel length $L_{tf}$ and the predetermined maximal load, or the test load $F_p$, are known.

To set up the clamping wedges 25 on the strands 7 of the tension members 4, 5, and 6 at the correct mutual distance in accordance with the invention, a mutual reference plane is beneficial, whereby its axial distance to the individual clamping planes A, B, C, are determined, and from there, the clamping planes A, B, C. are measured in.

In the example embodiment, the side face 23 of the clamping plate 21, which represents the tensioning plane 24, at the same time, serves as the reference plane. Because the clamping wedge 25 of the tension member 4 is firmly seated in the receptacle 22 of the clamping plate 21, its clamping plane A is already located in the tensioning plane 24, and thus in the reference plane. Therefore, only the distances $\Delta I_1$ from the reference plane to the clamping plane B of the clamping wedge 25 of the tension member 5, and $\Delta I_2$ from the reference plane to the clamping plane C of the clamping wedge 25 of tension member 6 still have to be measured in.

Figure 5A:
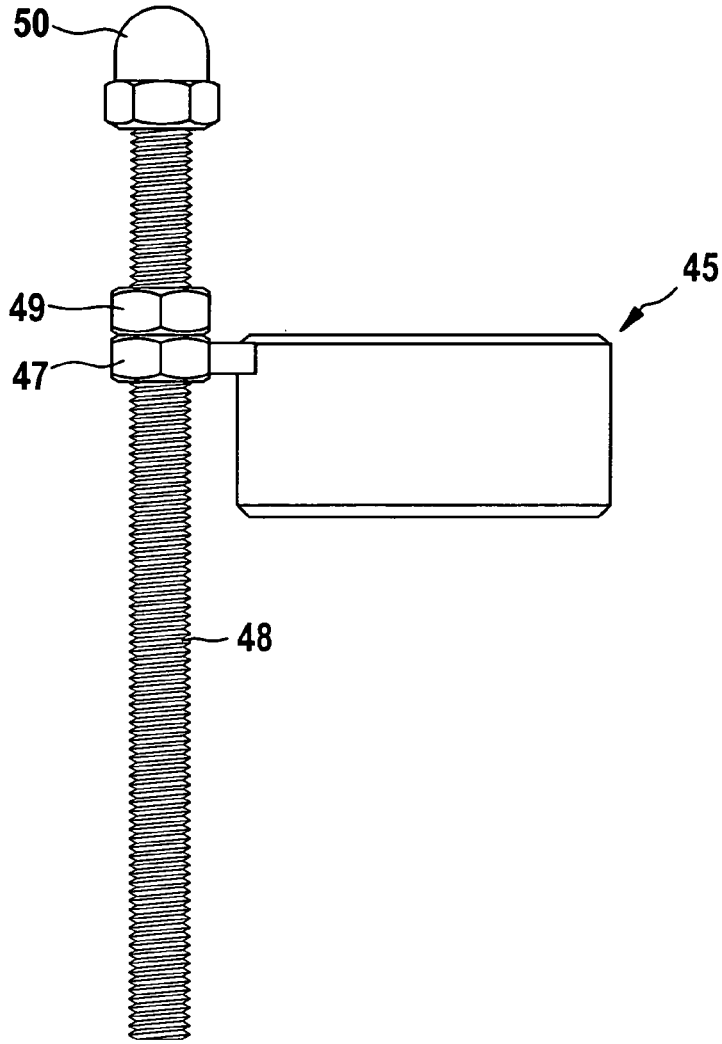
FIGS. 5*a* and 5*b* are lateral and top views of an adjustment element for a tensioning wedge of the arrangement illustrated in FIG. 2, according to an embodiment of the invention.
Figure 5B:
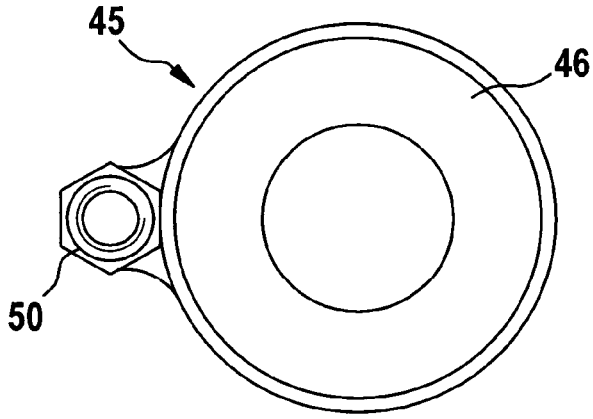
Figure 7:
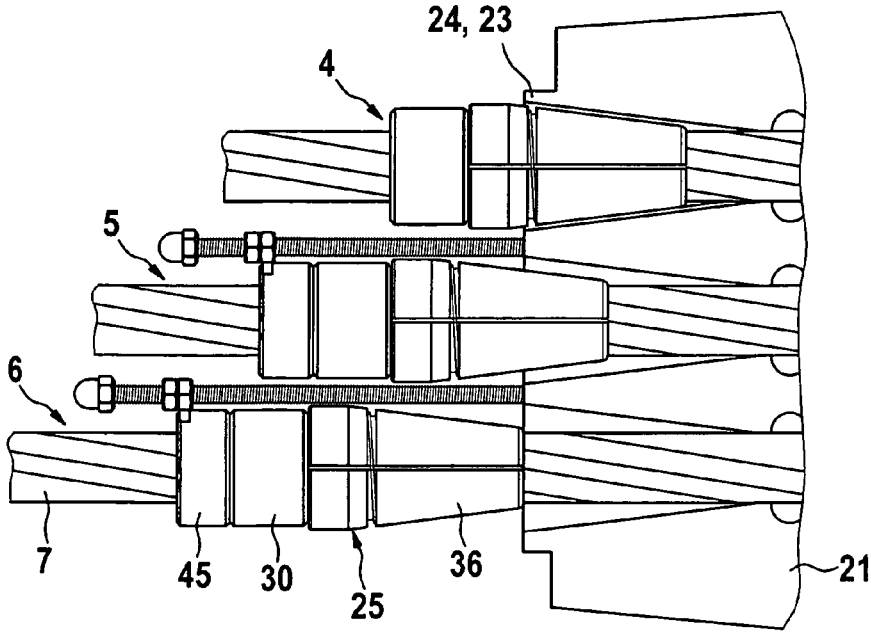
FIG. 7 is a longitudinal cross section of a staggered anchorage in the area of the tensioning plane during the setup of the tensioning wedges.

For this process, the adjustment element 45 illustrated in FIGS. 5*a* and *b* is particularly well suited, the application of which according to the invention is shown in FIGS. 6 and 7. The adjustment element 45 is essentially comprised of a ring wheel 46, which in diameter and size corresponds to the passage opening of fixing segment 30. On the outer periphery of ring wheel 46, a screw nut 47 is mounted, through which a threaded rod 48 can be threaded perpendicularly to the plane of a ring wheel 46. The position of the threaded rod 48 relative to the ring wheel 46 can be fixed by using a counternut 49. At the top end of the threaded rod 48, a capped nut 50 is attached. Preferably, a dedicated adjustment element 45 is kept ready for each clamping wedge 25 to be set up.

The application of the adjustment element 45 becomes obvious from FIGS. 6 and 7. Because with its upper side, a clamping wedge 25 extends beyond the clamping plane A, B, C, by the known wedge-specific value p, and the adjusting elements 45, together with the bottom side of the ring wheel 46, form a contact surface with upper side of the clamping wedges 25, the threaded rod 48 of each adjustment element 45 is initially adjusted to the required projection $P_{1,2}+\Delta I_{1,2}$ relative to the bottom side of the ring wheel 46 (see FIG. 6). $\Delta I_{1,2}$ equals the previously calculated value, by which the shorter tension members 5 and 6 are less elongated as compared to the longest tension member 4 so that when the predetermined maximal load is reached, all tension members 4, 5, and 6 are in the same state of tension.

The thusly predefined adjustment elements 45 are pushed, together with the clamping wedges 25, onto the ends of the strands 7 of tension members 5 and 6, in a way as is illustrated in FIG. 7, until each threaded rod 48 runs against the side face 23 of the clamping plate 21. This generates the distance $\Delta I_{1,2}$ in between the clamping planes A, B, C, in accordance with the invention.

By fastening the stud screw 35, the clamping wedges 25 are fixed into this position on the strands 7. Subsequently, the adjustment elements 45 can be removed from the strands 7. The state achieved in this way corresponds to the initial state illustrated in FIG. 2 prior to the activation of the multistrand jack 15.

Figure 8:
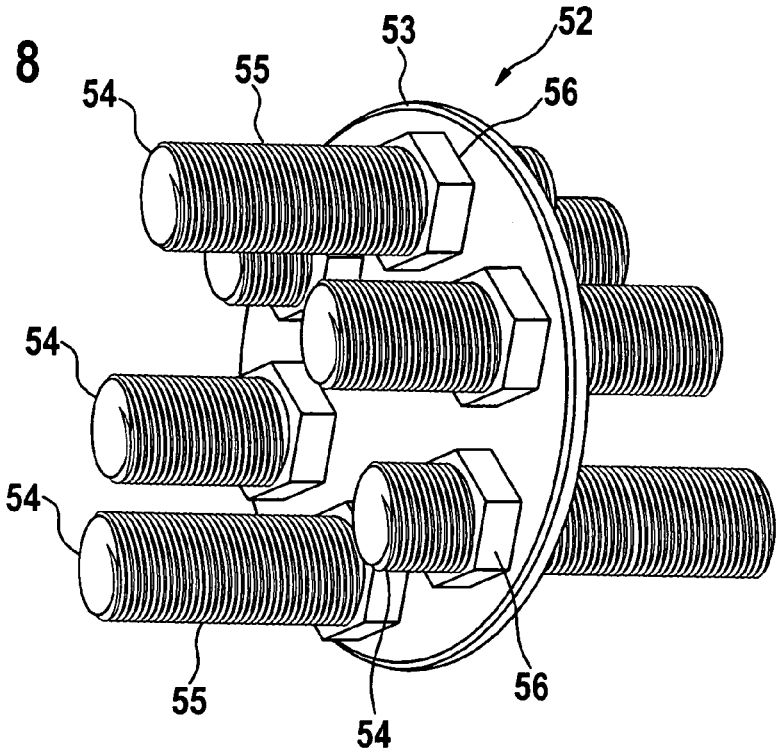
FIG. 8 illustrates a further embodiment of an adjustment element of the present invention.

An alternative embodiment of an adjustment element 52 of the present invention is illustrated in FIG. 8. There, a ring-wheel-shaped basic component 53 is illustrated, which is provided with passage bores corresponding to the number and arrangement of tension members 4, 5, 6. On their inner shell surface, the bores are provided with internal threads, which are not visible due to the view of the illustration chosen.

Through each of the bores, a distance sleeve 54 extends, the outer shell of which is provided with an external thread 55 corresponding to the internal thread. In this way, the distance sleeves 54 can be screwed into the passage bores of the basic component 53. By screwing the distance sleeves 54 into the basic component 53 at varying degrees, the position of the free end of the distance sleeves 54 can be adjusted. A counternut 56 screwed onto the distance sleeve 54 and resting on the basic component 53 fixes the location of the distance sleeve 54 into the adjusted position.

In this way, the distance sleeves 54 are adjusted in their mutual position such that their free ends are arranged at the distances of clamping planes A, B, C, whereby the distance sleeves 54 with the longest projections from the basic component 53 are assigned to the tension members 4, 5, with longer free steel lengths $L_{tf}$, and the distance sleeves 54 with shorter projections from basic component 53 are assigned to tension members 5, 6 with shorter free steel lengths $L_{tf}$.

The intended application of such an adjustment element 52 takes place after the locking elements, that is, in the instant example, the clamping wedges 25 comprised of clamping segment 36 and fixing segment 30, have been pushed onto the individual strands 7. Subsequently, the free ends of strands 7 of the individual tension members 4, 5, 6, are threaded one by one through their dedicated distance sleeves 54, and the adjustment element 52 as a unit is slid onto the strands 7 in the direction of the clamping plate 21. Little by little, the individual clamping wedges 25 thereby come to butt against the free ends of the distance sleeves 54 with the result that a distance of the clamping wedges 25 corresponding to the distance in between the clamping planes A, B, C, is generated.

In order to keep the elongation path as short as possible, it is beneficial for the adjustment element 52 to be slid onto the staggered anchorage 1 such as needed to enable the distance sleeve 54 with the longest projection beyond the basic component 53 to push the clamping wedge 25 on the tension member 4, 5 with the longest free steel length $L_{tf}$ into the corresponding receptacle 22 in the clamping plate 21. The staggered arrangement in a longitudinal direction of the remaining clamping wedges 25 on the tension members 5, 6, with shorter free steel lengths $L_{tf}$ thereby comes about automatically.

Figure 9:
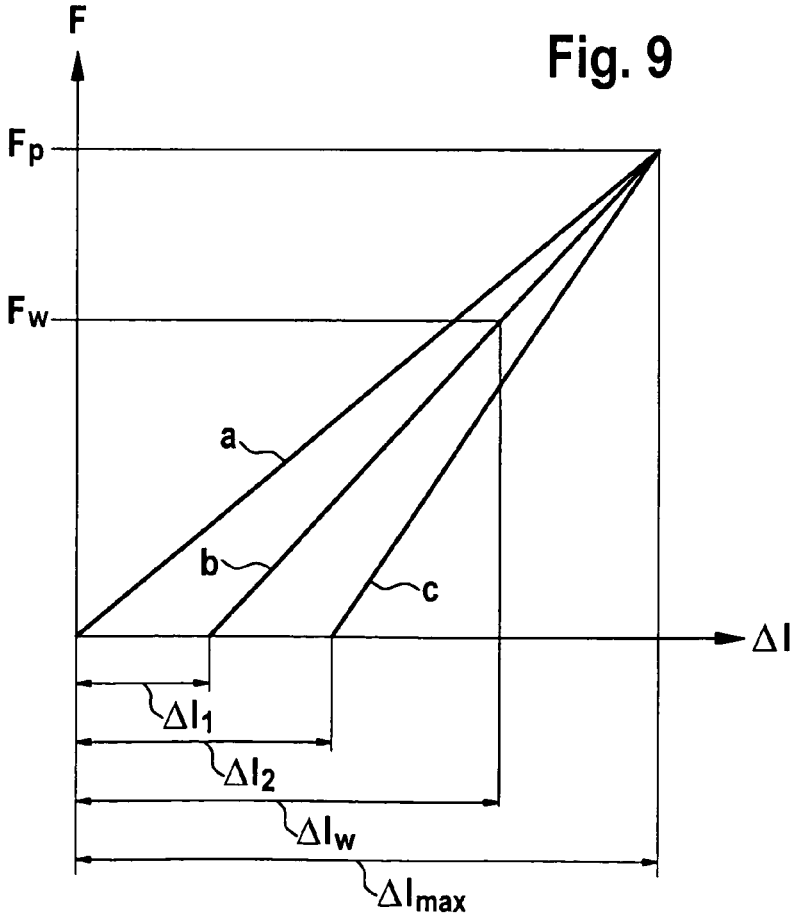
FIG. 9 is a diagram of the load-elongation behavior of the individual tension members.

The tensioning operation is described in more detail therebelow with reference to FIGS. 2 and 9. When the piston 17 is extended from the multistrand jack 15, the clamping plate 21 is moved along the tensioning axis 26 in the direction of arrow 27. Because the clamping wedges 25 on the strands 7 of the longest tension members 4 are already firmly seated in the receptacle 22 of clamping plate 21, the tensioning plane 24 is located in clamping plane A. By extending piston 17, a linearly increasing load is generated in tension member 4. The behavior of the load corresponds to line a illustrated in FIG. 9.

After reaching a tensioning value of $\Delta I_1$, the tensioning plane 24 arrives at a position that is congruent with that of clamping plane B, that is, the clamping wedges 25 on the strand 7 of the second-longest tension member 5 are seated with utmost precision in the receptacles 22. By extending the piston 17 even more, the two tension members 4 and 5 are now elongated, whereby the load in tension member 4 is further increased and a load with the behavior b is initiated in tension member 5.

With further tensioning of the staggered anchorage 1, the tensioning plane 24, after covering the tensioning path $\Delta I_2$, reaches the area of clamping plane C, and thus the clamping wedges 25 on the strands 7 of the shortest tension member 6 wind up in the receptacles 22. By further extending the cylinder 17 to a maximum tensioning path $\Delta I_1$, all tension members are now impacted with the predetermined maximum load. The tensioning behavior of the tension member 6 has the reference symbol c.

As can be seen in FIG. 9, the load increase in the individual tension members 4, 5, and 6 at constant elongation is the steeper, the shorter its free steel length $L_{tf}$ is. For this reason, shorter tension members have a tensioning behavior with a steeper incline. The distance $\Delta I_1$ of clamping plane A from B as well as the distance $\Delta I_2$ of clamping plane A from C is chosen such, taking into consideration the respective free steel lengths $L_{tf}$, that with increasing tensioning values, the stress diffusions a, b, c, converge such that in the individual tension members 4, 5, and 6, the predetermined maximum load, preferably the test load $F_p$, is reached simultaneously.

By subsequent detensioning of the staggered anchorage 1 by retracting the piston 17 by the value $\Delta I_{max}-\Delta I_w$, or by retracting the piston 17 and subsequent retensioning of the tension members 4, 5, 6, by the value $\Delta I_w$, the individual tension members 4, 5, and 6 are adjusted to the working load $F_w$ of the staggered anchorage 1. The arrival at the working load $F_w$ can then be indicated by the corresponding pressure or stroke of the jack. In this state, longer tension members are more tensioned than shorter tension members (FIG. 9). The result is a uniform elongation reserve for all tension members 4, 5, 6, of the staggered anchorage 1, namely $\Delta I_{max}-\Delta I_w$.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for tensioning a staggered anchorage having a plurality of tension members that are anchored in a bore hole and have different free steel lengths, the method comprising the steps of:

adjusting each tension member to a predetermined maximal load and then subsequently to a working load, and adjusting all tension members to a reduced elongation by a uniform elongation difference relative to a respective elongation of the predetermined maximal load to adjust the staggered anchorage to the working load.

2. The method according to claim 1, wherein the predetermined maximal load substantially equals the test load.

3. The method according to claim 1, wherein the working load is adjusted by detensioning the tension members.

4. The method according to claim 1, wherein the adjustment of the tension members to the working load is path-dependent or force-dependent.

5. The method according to claim 3, wherein all tension members are detensioned simultaneously.

6. The method according to claim 1, wherein a tensioning procedure is started with tension members having a longer free steel length followed by tension members with a shorter free steel length.

7. The method according to claim 1, wherein a tensioning procedure is completed simultaneously for all tension members.

8. The method according to claim 1, wherein tension members having a substantially equal free steel length are tensioned simultaneously.

9. The method according to claim 1, wherein the tension members are tensioned independently from one another.

10. The method according to claim 1, wherein said tensioning is initiated in the order of the tension member having the longest free length first followed in sequence by each tension member having the next longest free length, with said tension members being tensioned to said working toad simultaneously.

11. A method for tensioning a staggered anchorage having a plurality of tension members that are anchored in a bore hole and have different free steel lengths, the method comprising the steps of:

adjusting each tension member to a predetermined maximal load and then subsequently to a working load, and adjusting all tension members to a reduced elongation by a uniform elongation difference relative to a respective elongation of the predetermined maximal load to adjust the staggered anchorage to the working load, wherein the tensioning of the tension members is performed for all tension members in a single tensioning plane, wherein, prior to the tensioning, a clamping plane is determined for each tension member and upon reaching the clamping plane of a tension member a force coupling between the tensioning plane and the tension member is established by the tensioning plane, and wherein, in a tensioning direction, the clamping planes of shorter tension members are arranged after the clamping planes of longer tension members.

12. The method according to claim 11, wherein a distance between the clamping planes is determined such that when a defined maximum load of the staggered anchorage is reached, all tension members have a substantially equal state of tension or are substantially equal to a test load.

13. The method according to claim 11, wherein a distance between the clamping planes is substantially equal to a difference in an elongation of each tension member before a predetermined maximal load or a test load is reached, due to the varying free steel lengths of the individual tension members.

14. An arrangement for tensioning a staggered anchorage, the arrangement comprising:

a plurality of tension members having varying free lengths of steel;

a clamping plate arranged in a tensioning plane that is moved by a hydraulic jack in a tensioning direction, the hydraulic jack being arranged between an anchorage plane on a bore-hole side and the tensioning plane, the tensioning plane extending radially from said tensioning direction; and a locking element being provided for each tension member, the locking element fixing the tension members to the clamping plate in the tensioning plane, wherein a plurality of tension members having various free steel lengths are dedicated to the clamping plate, and wherein the locking elements are arranged in staggered clamping planes relative to the tensioning direction.

15. The arrangement according to claim 14, wherein all locking elements for tension members with substantially equal free steel lengths are dedicated to the same clamping plane.

16. The arrangement according to claim 14, wherein the tension members with identical free steel lengths are evenly distributed on a peripheral line relative to the tensioning axis.

17. The arrangement according to claim 14, wherein, in the tensioning direction, the clamping plane of tension members with shorter free steel lengths are arranged after the clamping plane of tension members with longer free steel lengths.

18. The arrangement according to claim 14, wherein a distance between the clamping planes is provided so that when the staggered anchorage is impacted with a predetermined maximal load all tension members are in a substantially equal state of tension or substantially equal to a test load.

19. The arrangement according to claim 14, wherein a distance of two successive clamping planes substantially equals a distance of an elongation of the individual tension members, and wherein tension members having longer free steel lengths have substantially the same load as tension members having shorter free steel lengths.

20. The arrangement according to claim 14, wherein the locking element includes a multi-link wedge-shaped clamping segment and a fixing segment, which are connected to one another, and wherein the fixing segment facilitates the locking element to be fixed on the tension member in the corresponding clamping plane, and the clamping segment facilitates the tension member to be fixed in position in the tensioning plane.

21. The arrangement according to claim 20, wherein the clamping segment and the fixing segment are formfittingly interconnected in an overlapping area, the overlapping area including an annular slot and an annular flange.

22. The arrangement according to claim 20, wherein the fixing segment has an annular shape and has a radial threaded bore in which a stud screw for fixing the fixing segment into position on the tension member is arranged.

23. The arrangement according to claim 14, further comprising an adjustment element for orientating a locking element in a corresponding clamping plane, wherein the adjustment element contacts the locking element for forming a reference plane, and wherein the adjustment element has a spacer acting against a reference surface or against the clamping plate.

24. The arrangement according to claim 23, wherein the adjustment element includes a ring wheel that can be slid onto a tension member.

25. The arrangement according to claim 23, wherein the spacer is adjustable to various distances between the clamping planes and the tensioning plane.

26. The arrangement according to claim 23, wherein the spacer includes a threaded rod, which is guided in a screw nut that is attached to the ring wheel, and which is fastened with a counternut.

27. The arrangement according to claim 23, wherein the adjustment element is removed from the locking element, to allow the removal of the adjustment element from the tension member after the locking element has been set up.

28. The arrangement according to claim 14, further comprising an adjustment element for orientating locking elements in the corresponding clamping plane, wherein the adjustment element includes a basic component to which axis-parallel distance sleeves that are adjustable in their longitudinal axis are mounted, wherein ends of distance sleeves are arranged in a staggered array corresponding to the distance of the clamping planes between one another, and wherein each distance sleeve is designated to a corresponding tension member so that by sliding the adjustment element onto free ends of the tension members, the locking elements are brought next to ends of the distance sleeves, which results in a staggered array in the clamping planes.

29. The arrangement according to claim 28, wherein the basic component is provided with axis-parallel bores with internal thread, and wherein the distance sleeves are provided with an external thread corresponding to the interior thread, so that by adjusting their screw connection to the basic component, the distance sleeves are adjustable in their relative position to one another in a longitudinal direction.

30. The arrangement according to claim 29, wherein a counternut, which is screwed onto the distance sleeves to fix the distance sleeves into position on the basic component.

31. The arrangement according to claim 28, wherein the basic component is disk-shaped or an annular disk.

* * * * *